US005768651A

United States Patent [19]

Shideler et al.

[11] Patent Number: 5,768,651

[45] Date of Patent: Jun. 16, 1998

[54] PHOTOGRAPHIC PROCESSING APPARATUS

[75] Inventors: Stephen C. Shideler, Hilton; Richard G. Mackson, Pittsford, both of N.Y.

[73] Assignee: Eastman Kodak Company, Rochester, N.Y.

[21] Appl. No.: 802,144

[22] Filed: Feb. 19, 1997

[51] Int. Cl.[6] ..... G03D 5/00; G03D 3/08

[52] U.S. Cl. ..... 396/604; 396/612; 396/627

[58] Field of Search ..... 396/603, 612, 396/620, 622, 604, 609, 627

[56] References Cited

U.S. PATENT DOCUMENTS

| | | | |
|---|---|---|---|
| 4,736,222 | 4/1988 | Stromberg | 396/618 |
| 4,758,858 | 7/1988 | Blackman et al. | 396/626 |
| 5,452,043 | 9/1995 | Patton et al. | 396/626 |

OTHER PUBLICATIONS

Science and Technology, Reinventing Kodachrome, Feb. 15, 1997, pp. 79 & 80.

*Primary Examiner*—D. Rutledge

*Attorney, Agent, or Firm*—Frank Pincelli; David A. Novais

[57] ABSTRACT

A processing apparatus for processing a web of photosensitive material having an emulsion layer on one side. The apparatus has at least one development section. The development section comprises an elongated narrow processing chamber having an entrance port for receiving a processing solution under pressure; a processing tube disposed within the elongated narrow processing chamber and forming a narrow fluid passageway between the chamber and the processing tube, the web passing through the processing tube at a fixed predetermined orientation and position so as to define a longitudinal axis with respect to the photosensitive material, the processing tube having at least one row of processing openings for introducing processing fluid from the passageway into the processing tube against the emulsion layer substantially across the width of the emulsion layer. The elongated chamber may be formed using an elongated tube placed around the processing tube. The inner tube may have an elliptical cross-sectional configuration.

26 Claims, 8 Drawing Sheets

PHOTOGRAPHIC PROCESSING APPARATUS

FIELD OF THE INVENTION

The present invention relates to a photographic processing apparatus and, more particularly, to an apparatus for processing a web of photosensitive material.

BACKGROUND OF THE INVENTION

Is known to provide an elongated narrow processing channel through which a web of photosensitive material is passed for processing. An example of such processors is illustrated in U.S. Pat. Nos. 4,736,222 and 4,758,858. In these patents there is disclosed an apparatus wherein a processing solution is pumped from an adjacent tank through a plurality of openings provided in a separating wall against the emulsion side of the photosensitive material. The processing solution exits the processing channels through a plurality of openings provided on the opposite side of each processing channel. A problem encountered with such processors is that circulation of the processing solution in the tank is not adequate. As a result, dead spots would occur in certain areas of the processing solution in the processing tank. Another problem encountered is the uniformity of development of the photosensitive material. A further problem encountered with such devices is non-uniformity of the impingement of the processing solution against the photosensitive material. The use of narrow processing channels also added significantly to the cost of the apparatus and difficulty in manufacturing, and/or maintaining the apparatus.

Applicants have invented an improved processing apparatus that overcomes the problems of the prior art. A processing apparatus made in accordance with the present invention provides uniform and consistent development of the photosensitive material and is relatively low cost to manufacture and easy to assemble and disassemble.

SUMMARY OF THE INVENTION

In accordance with one aspect of the present invention there is provided a processing apparatus for processing a web of photosensitive material having an emulsion layer on one side. The apparatus has at least one development section comprising:

a) an outer tube having an entrance port for receiving a processing solution under pressure;

b) an inner tube for receiving a web of photosensitive material having an emulsion layer therethrough, the web having a longitudinal axis, the inner tube being disposed within the outer tube and forming a fluid passageway between the outer tube and the inner tube, the inner tube having at least one row of processing openings for introducing fluid from the passageway into the inner tube and against the emulsion layer, the row of processing openings being positioned in the inner tube so that the at least one row of openings face the emulsion layer and are disposed at an angle with respect to the longitudinal axis of the web.

In accordance with another aspect of the present invention there is provided a processing apparatus for processing a web of photosensitive material having an emulsion layer on one side. The apparatus having at least one development section comprising:

a) a first elongated processing chamber having a first entrance port for receiving a processing solution under pressure;

b) a first inner tube disposed within the first elongated processing chamber and forming a fluid passageway between the elongated processing chamber and first inner tube;

c) a second elongated processing chamber having a second entrance port for receiving a processing solution under pressure;

d) a second inner tube disposed within the second elongated processing chamber and forming a fluid passageway between the exit elongated processing chamber and second inner tube; and e) a turn-around section for connecting the first inner tube to the second inner tube, the web passing through the first inner tube and second tube at a fixed predetermined orientation and position so as to define a longitudinal axis with respect to the photosensitive material, the first and second inner tubes each having at least one row of processing openings for introducing fluid from the passageway into the inner tubes and against the emulsion layer, the row of processing openings being positioned so that the rows of openings face the emulsion layer and are disposed at an angle with respect to the longitudinal axis of the web.

In accordance with yet another aspect of the present invention there is provided a processing apparatus for processing a web of photosensitive material having an emulsion layer on one side. The apparatus having at least one development section comprising:

a) an elongated narrow processing chamber having an entrance port for receiving a processing solution under pressure; and b) a processing tube disposed within the elongated narrow processing chamber and forming a narrow fluid passageway between the chamber and the processing tube, the web passing through the processing tube at a fixed predetermined orientation and position so as to define a longitudinal axis with respect to the photosensitive material, the processing tube having means for introducing processing fluid from the passageway into the processing tube against the emulsion layer substantially across the width of the emulsion layer.

DESCRIPTION OF THE DRAWINGS

Other objects, advantages and features of the present invention will become apparent from the following specification when taken in conjunction with the drawings in which like elements are commonly enumerated and in which.

DETAILED DESCRIPTION OF THE INVENTION

Figure 1:
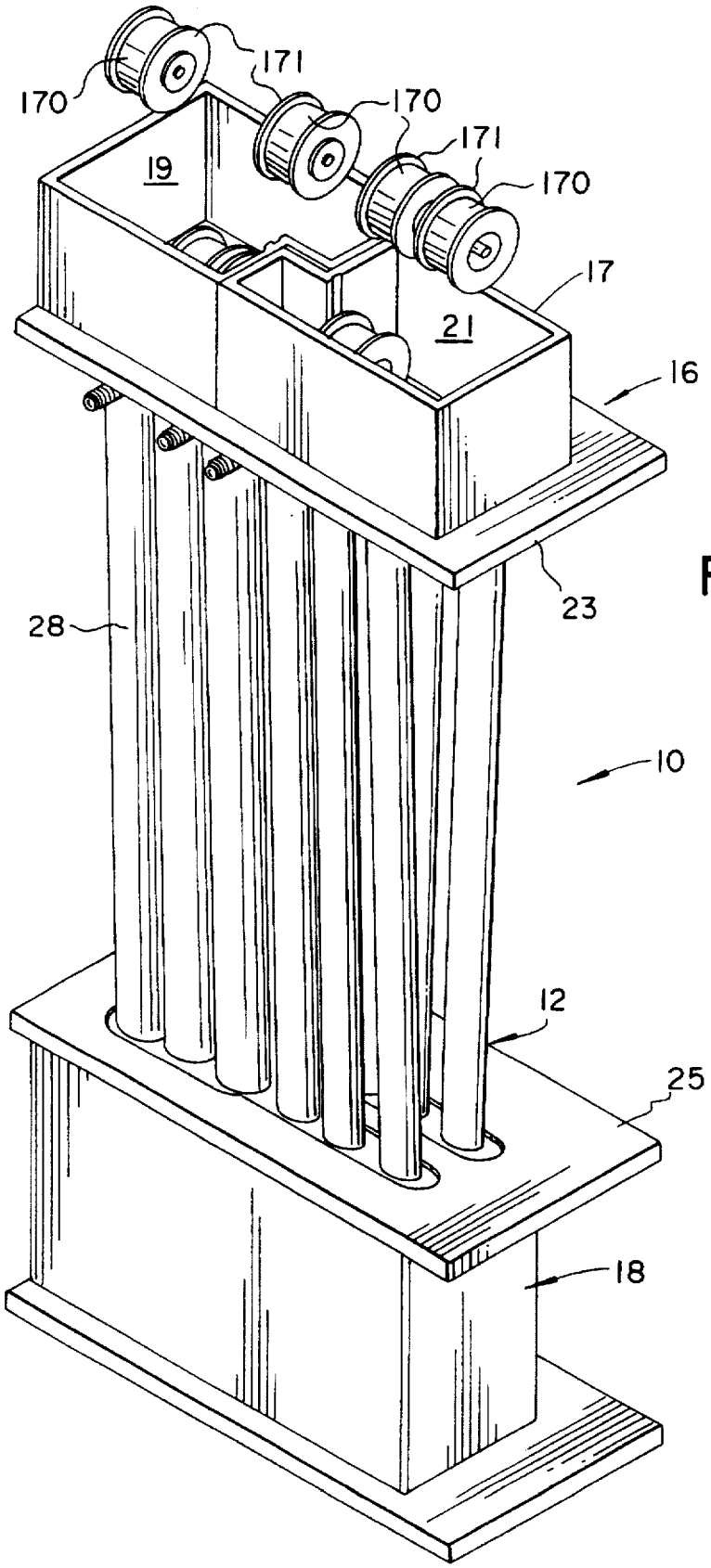
FIG. 1 is a perspective view of a processing apparatus made in accordance with the present invention.
Figure 2:
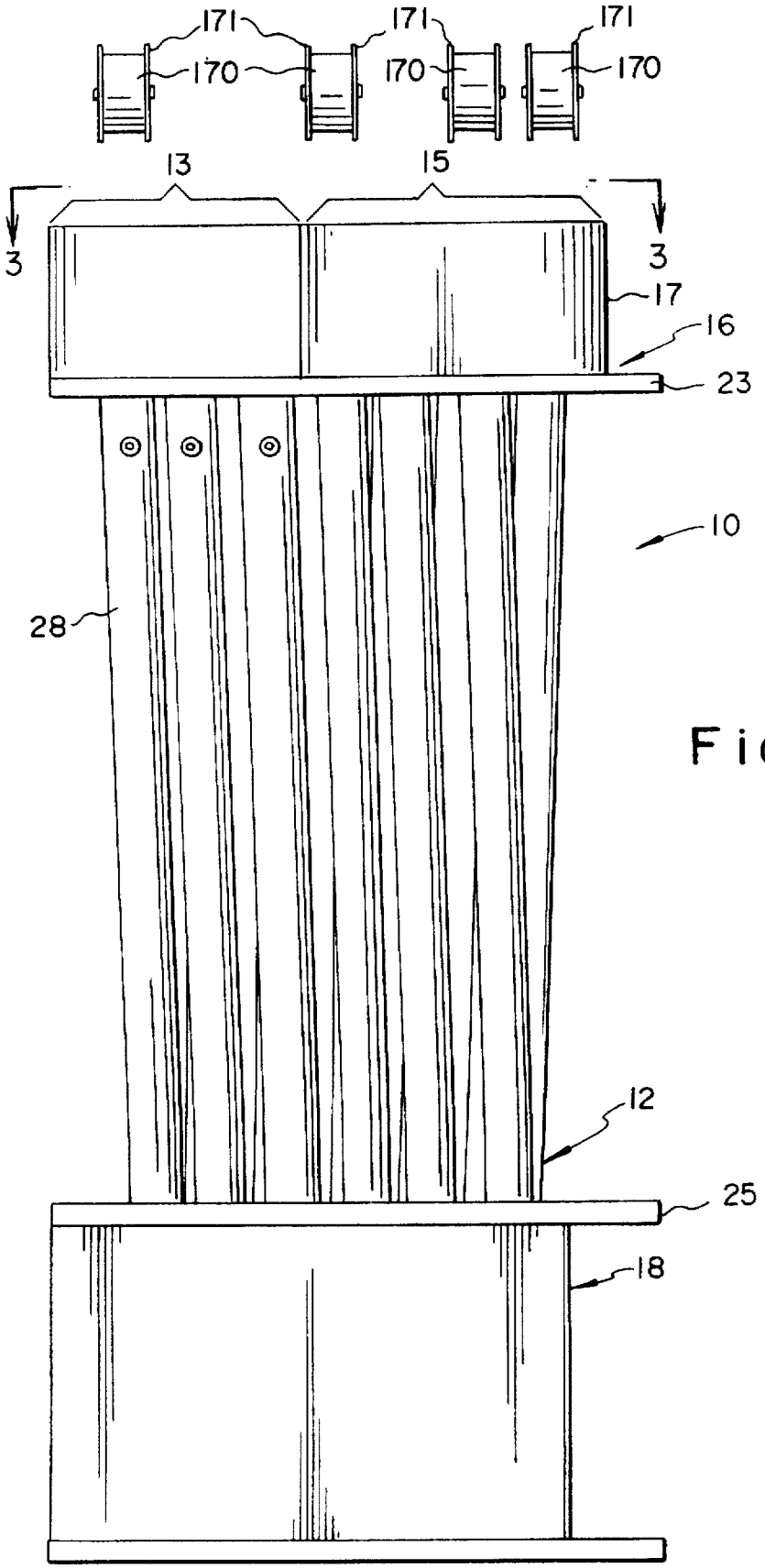
FIG. 2 is front elevational view of a processing apparatus of FIG. 1.

Referring to FIGS. 1–5, there is a processing apparatus 10 made in accordance with the present invention. The apparatus 10 has at least one processing section 12 for processing a photosensitive material 14 (see FIG. 2). While in the particular embodiment illustrated photographic film is illustrated as being processed, any desired web of photosensitive material may be processed. Also, in the embodiment illustrated, only one processing section is illustrated, however, any desired number of additional processing sections may be provided for subjecting the photosensitive material to any desired number of processing solutions.

Processing section 12 comprises a development section 13 and a rinse section 15. The processing section 12 includes an upper mounting section 16 and a lower mounting section 18. The upper mounting section includes an upstanding wall 17 which forms a fluid retention well 19 around development section 13 and fluid retention well 21 around rinse section 15. The upper mounting section also includes a mounting plate 23.

The lower mounting section 18 includes a processing sump 20 for holding a processing solution 22 and a rinse sump 24 for holding a rinsing solution 26. The lower mounting section also includes a lower mounting plate 25. The upper and lower mounting sections 16,18 are preferably made of a suitable plastic material as is commonly used in current processors. The processing solution 22 may comprise any appropriate solution, for example, but not by way of limitation, developer solution, bleach-fix solution and the rinse solution 26 may comprise water.

A plurality of outer tubes 28,30,32,34,36,38 are provided in development section 13 which extends between the upper mounting section 16 and lower mounting section 18. The outer tubes are also preferably made of a suitable plastic material as is commonly used in photographic processors. The tubes 28,30,32,34,36,38 have a length L and maximum internal width WM (see FIG. 6) so as to define an elongated processing chamber 40. An inlet port 39 is provided on each outer tube for supplying of processing solution under pressure to chamber 40. For the purpose of the present invention, an elongated processing chamber shall be considered a chamber where the length L of the chamber is at least three times the maximum width MW of the chamber, preferably at least five times. Disposed in each of the outer tubes 28,30,32,34,36,38 there is provided inner tubes 42,44,46, 48,50,52, respectively. The inner tubes each have an upper open end 53 and a lower open end 55. The inner tubes 42–52 extend from near the tops 54 of outer tubes 28–38 to the bottoms 56, and are spaced from its respective outer tube so as to form a fluid supply passageway 62 therebetween (see FIGS. 5 and 6).

The outer tubes 28,30,32,34,36,38 and their associated inner tubes are paired up so as to provide three processing loops 65,67,69 which form a processing path in processing section 12. In each of the processing loops 65,67,69 the inner tubes are fluidly connected to each other and provide a processing path through which the photosensitive material 14 travels through the development section 13. Thus, inner tube 42 is fluidly connected to inner tube 44, inner tube 46 is fluidly connect to inner tube 48, and inner tube 50 is fluidly connected to inner tube 52.

Figure 5:
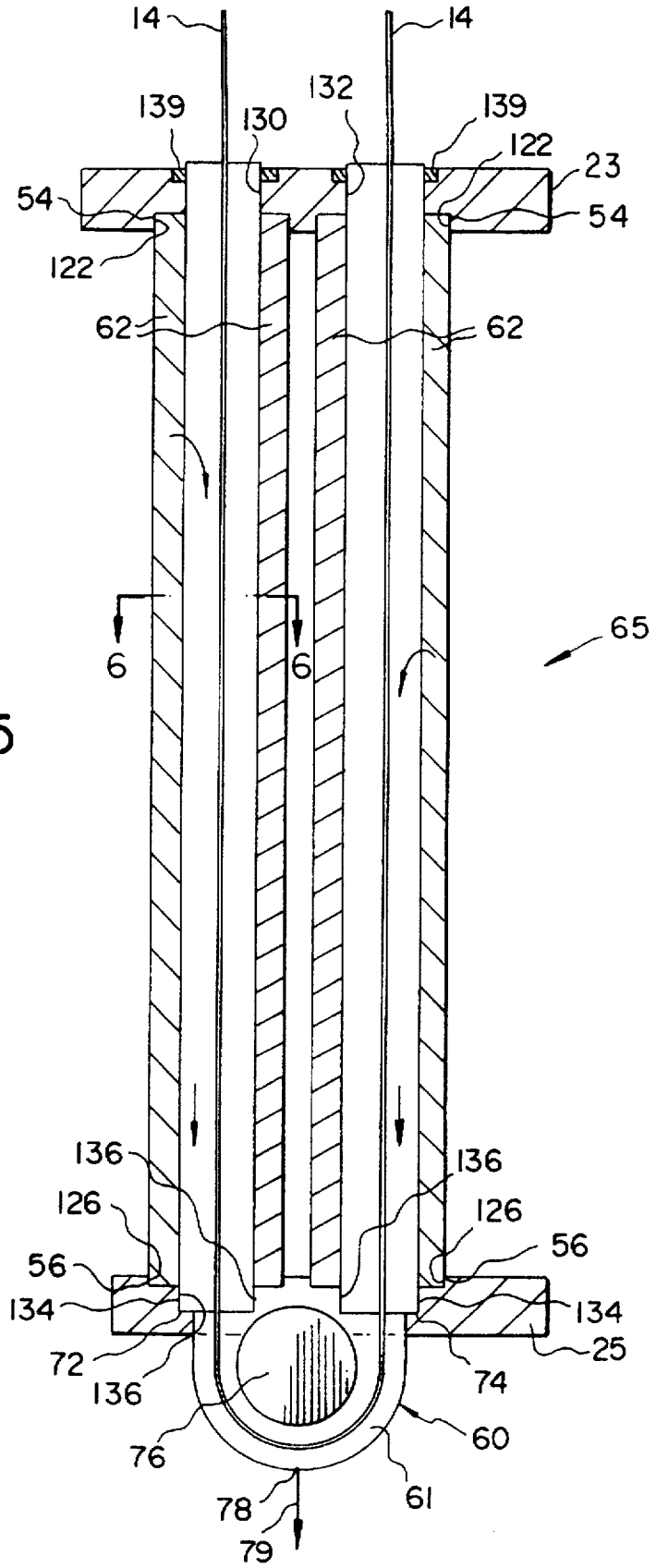
FIG. 5 is a cross-sectional view of one of the processing loops of the apparatus of FIG. 1.

Referring to FIG. 5 there is illustrated in greater detail a cross-sectional view of processing loop 65. It is to be understood that the remaining loops 67 and 69 are similarly constructed. The lower open end 55 of inner tube 42 is fluidly connected to lower open end 55 of inner tube 44 by a turn-around section 60 which mates with the lower ends 72,74 of tubes 42,44, respectively. Turn-around section 60 is used for turning the direction around of the photosensitive material 14 passing from tube 42 to inner tube 44. The turn-around section 60 includes a roller 76 which guides the photosensitive material 14 through a narrow passageway 61. A discharge opening 78 is provided in turn-around section 60 for allowing processing solution to flow from passageway 61 to sump 20 as indicated by arrow 79.

The upper end 54 of tubes 28 and 30 are secured into a mating recess 122 provided in mounting plate 124 of upper mounting section 16. In the embodiment illustrated, the upper end 54 is secured by an appropriate adhesive. The lower end 56 of tubes 28 and 30 are placed in mating recesses 126 in mounting plate 25 in lower section 18. The lower ends 56, in the embodiment illustrated, are also secured to plate 25 by an appropriate adhesive. Thus, the processing solution 22 that is introduced into passageway 62 through inlet port 39 can not go anywhere except through openings provided in inner tubes discussed later herein.

The inner tubes 42,44 pass through respective openings 130,132 in upper mounting plate 23. The lower end 134 of the tubes 42,44 are each placed in a mating recess 136 shaped to correspond to the outer configuration of the inner tubes 42,44 provided in lower mounting plate 25. FIG. 5 illustrates the tubes 42,44 in their fully seated position for operation of apparatus 10. An O-ring seal 139 is provided in openings 130,132 so that processing solution supplied to passageway 62 will not leak out of the processor. The inner tubes 42,44 are simply placed into or removed from the apparatus by vertically moving the tubes into or out of seating engagement with its associated seated position. This construction allows easy access to the interior of chamber 40 of outer tubes for servicing or clearing of any jams or obstructions.

Figure 4:
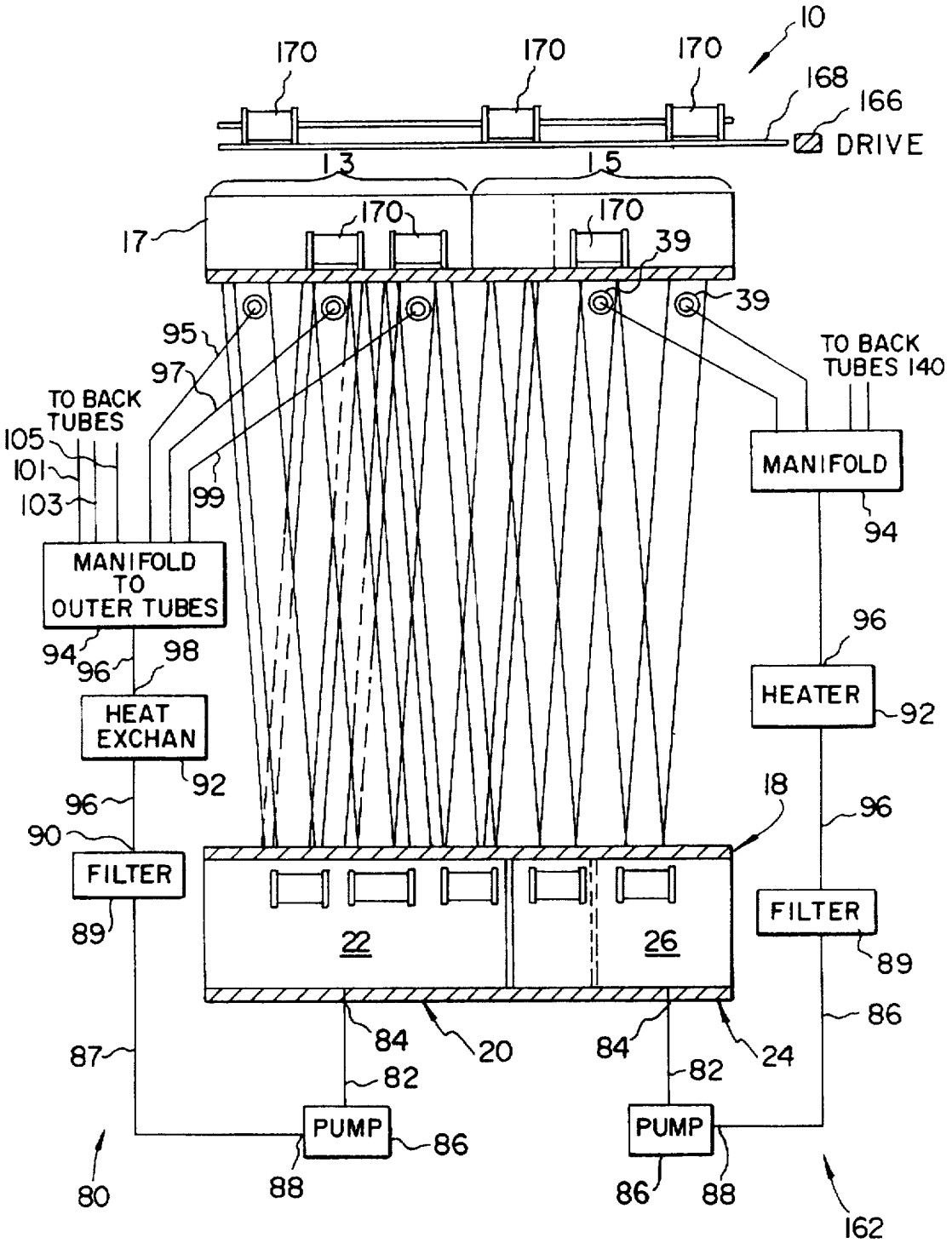
FIG. 4 is a schematic illustration of the apparatus of FIG. 1.

As best seen by reference to FIG. 4, a recirculation system 80 is provided for recirculating processing solution through the processing section 12. In particular, conduit 82 provides fluid communication between outlet 84 in sump 20 to pump 86. Second conduit 87 provides fluid communication between the outlet 88 of pump 86 to filter 89. The outlet 90 of filter 89 is fluidly connected to heater 92 through conduit 96 and the outlet 98 of heater 92 is fluidly connected to manifold 94 by conduit 96. Conduits 95,97,99,101,103,105 provide fluid communication to each of the inlet ports 39 in development section 13.

Figure 6:
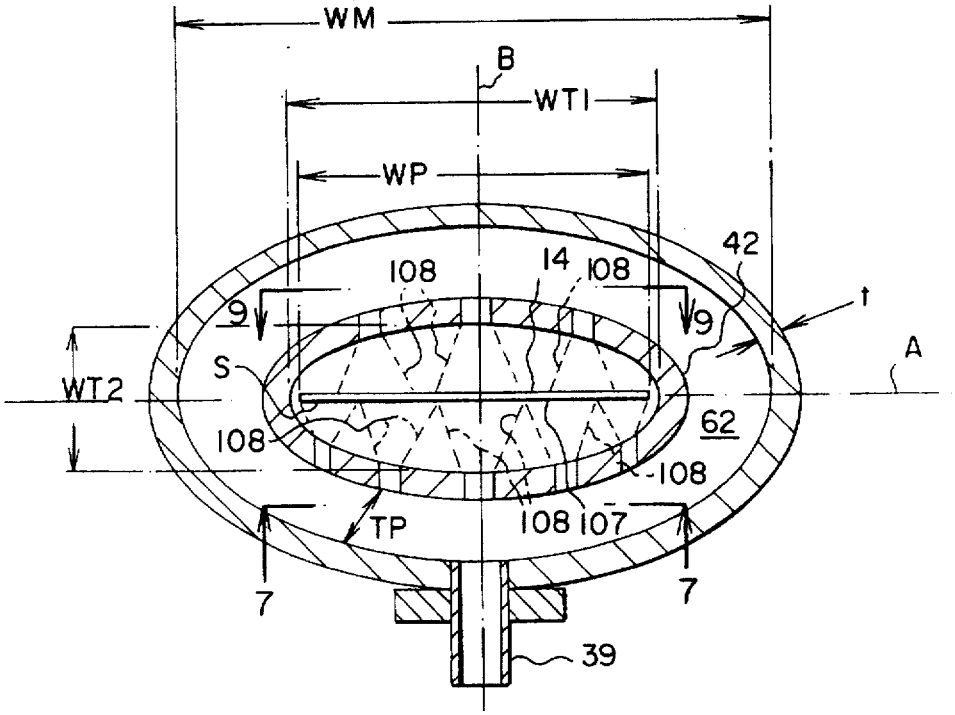
FIG. 6 is a cross-sectional view of one of the legs of the loop of FIG. 5 as taken along line 6—6.
Figure 3:
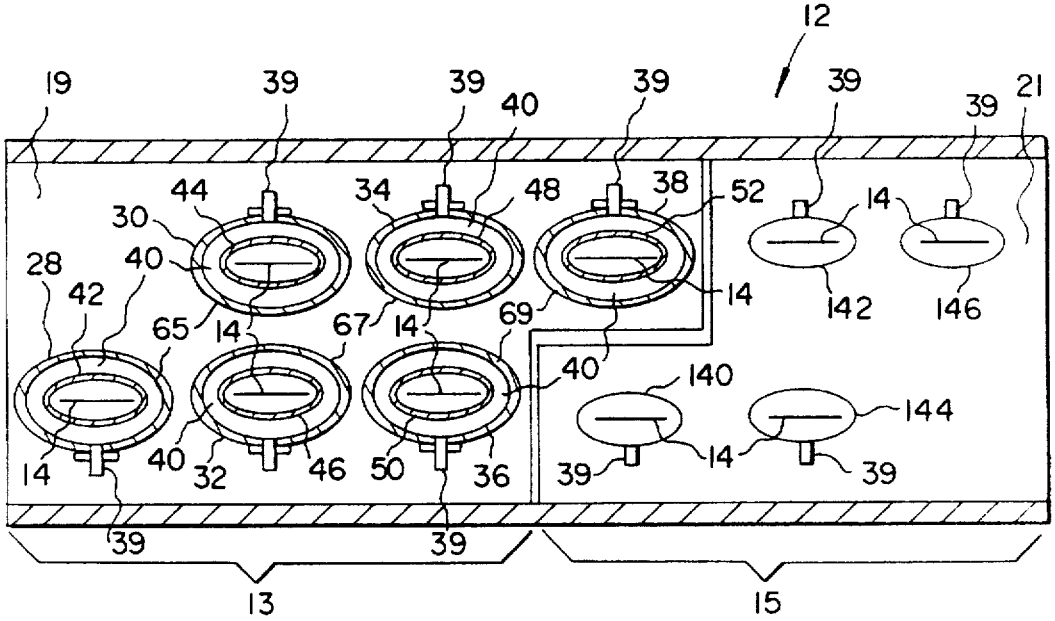
FIG. 3 is top plan view of the apparatus of FIG. 1 as taken along line 3—3.

Referring to FIG. 6, there is illustrated a cross-sectional view of one the legs of loop 65 as taken along line 6—6 showing in greater detail the shape and construction of inner tube 42 and its associated outer tube 28. For the sake of clarity, only a description of inner tube 42 will be provided in detail, it being understood that the remaining inner and outer tubes are similarly constructed. The tube 42 is preferably made of a plastic material as is commonly used in existing photographic processors, for its ease of construction, low cost and resistance to the corrosive photographic processing solutions. The tube 42 has a wall thickness t sufficient to provide the required rigidity. In the embodiment illustrated, t is about 0.0625 inches(1.59 mm). In the preferred embodiment illustrated, the tube 42 has an elliptical cross-sectional configuration having a major axis A and a minor axis B. The major axis A is substantially co-extensive with the planar surface S of the web of photosensitive material 14. The width WT1 of the inside surface of the inner tube 42 as taken along the major axis A is larger than the width WP of the photosensitive material 14, preferably only an amount sufficient to allow the photosensitive material to pass therethrough without contacting the sides of the inner tube 42. In the embodiment illustrated, WT1 is greater than WP by an amount equal to about 0.060 inches. The width WT2 of the inside surface to the tube 42 as taken along the minor axis is such that a sufficient degree of rigidity is provided to the inner tube 42 so that it withstands the fluid pressure being applied without substantial deformation in the direction of the minor axis B and without requiring the thickness t of the wall of tube 42 to be excessively thick. Applicants have found that when the photosensitive material to be processed is photographic film having a width WP of 35 mm, suitable results can be obtained using a tube 42 made of clear PVC plastic having a wall thickness t of about 0.0625 inches (1.59 mm), a WT1 of about 1.5 inches (38.1 mm) and a WT2 of about 0.875 inches (22.1 mm).

Figure 7:
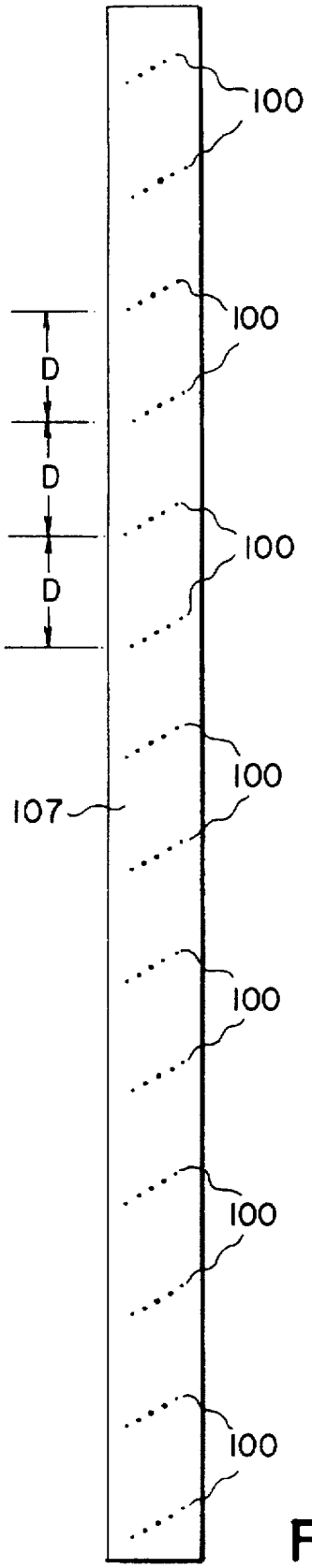
FIG. 7 is an elevational view of the inner tube of the loop of FIG. 6 as taken along line 7—7.
Figure 8:
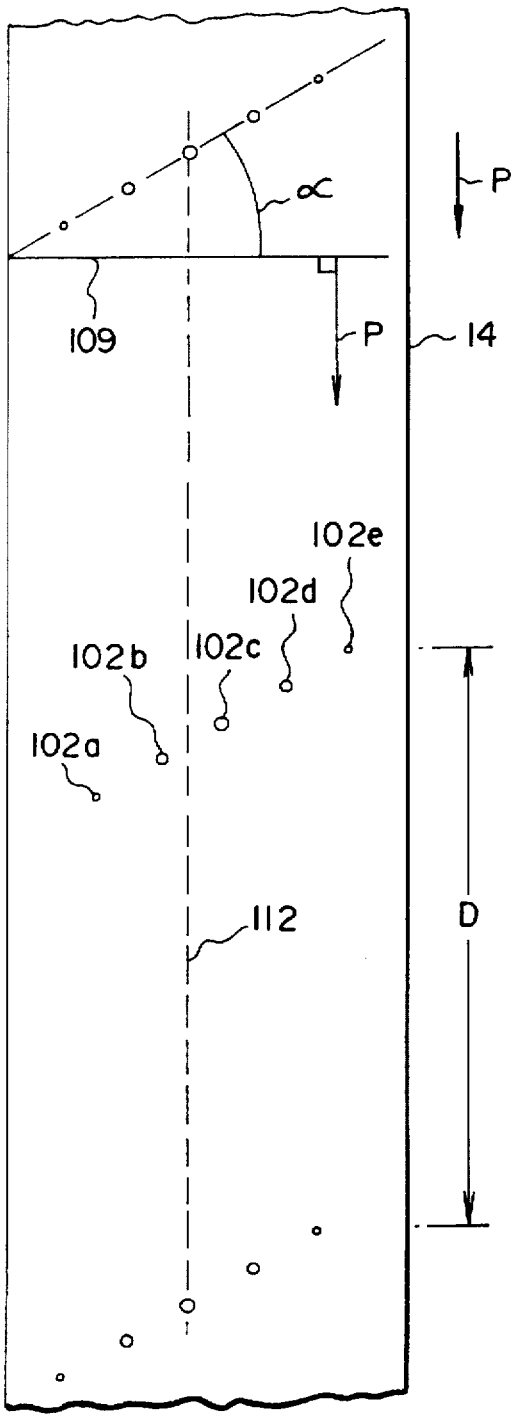
FIG. 8 is an enlarged partial view of a portion of the inner tube of FIG. 7.
Figure 10:
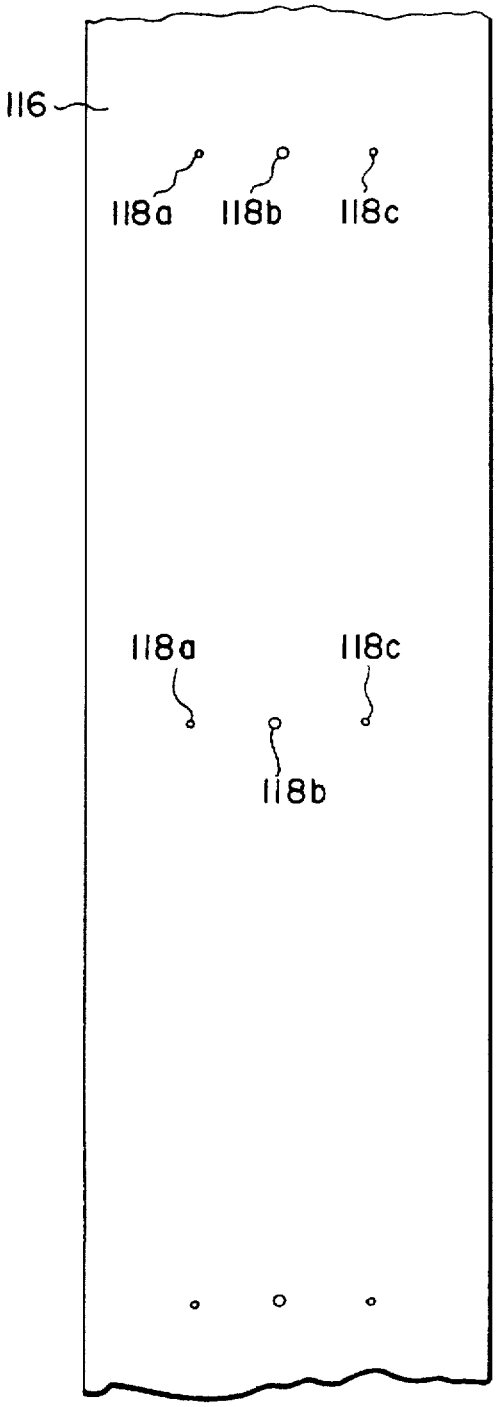
FIG. 10 is an enlarged partial view of a portion of the inner tube of FIG. 9.

Referring to FIG. 7, there is illustrated an elevational view of the inner tube 42 as taken along line 7—7 of FIG. 6. FIG. 8 is an enlarged view of a portion of the tube of FIG. 7. A plurality of rows 100 of openings 102*a*, 102*b*, 102*c*, 102*d*, 102*e* are provided for directing processing solution against the emulsion layer provided on surface 107 of photosensitive material 14 (see FIG. 6). The openings are positioned across the tube 42 such that processing solution 22 impinges across the entire emulsion layer on surface 107. The rows 100 of openings 102 are spaced a distance D apart along the length of tube 42. The distance D will vary depending upon the velocity of the photosensitive material 14 passing through the inner tube 42. In the particular embodiment illustrated, the distance D is about 2.0 inches (5.08 cm).

Referring to FIG. 8, there is illustrated in greater detail the orientation and size of the openings 102 in rows 100 which face the emulsion side 107 of the photosensitive material. The processing solution 22 is provided under pressure to openings 102 such that the processing solution 22 will impinge against the photosensitive material 14 so as to provide turbulent flow of processing solution 22 at the surface 107 of the photosensitive material 14. Applicants have found that in order to provide uniform processing of the photosensitive material 14, the openings 102 are preferably a particular orientation with respect to the path of travel P of the photosensitive material and a particular size depending on its location in inner tube 42. In order to compensate for the further distance, some of the openings 102 are from the surface 107, the further the opening is away, the greater its size. Thus, the opening 102*c* has the greatest size as it lies along the minor axis B, the openings 102*b* and 102*d* have a slightly smaller size, and openings 102*a* and 102*e* have an even smaller size. In the particular embodiment illustrated, the openings 102*a*, 102*b*, 102*c*, 102*d*, 102*e* all have a circular shape, as this allows for ease of manufacture and also provides a uniform spray of processing solution. Dash lines 108 in FIG. 6 provide an illustration of flow pattern of the processing solution against the photosensitive material 14. In the particular embodiment illustrated, the opening 102*c* has a diameter of 0.055 inches (1.397 mm), openings 102*b* and 102*d* have a diameter of 0.052 inches (1.32 mm), and openings 102*a* and 102*e* have a diameter of 0.032 inches (0.8128 mm). However, the specific size will vary depending on the shape and size of inner tube 42 and the pressure at which the processing solution is being applied.

The rows 100 of openings 102 are oriented at an angle α with respect to a line 109 perpendicular to the path of travel P as illustrated in FIG. 8. Applicants have found that this assists in eliminating and/or minimizing non-uniform development of the photosensitive material 14. Angle α is greater than 10°, preferably ranging from 20° to 45°. In the particular embodiment illustrated, α is 30°. The openings 102 in adjacent rows 100 are preferably offset in the longitudinal direction as illustrated in FIG. 8 by dash line 112. In the particular embodiment illustrated, the openings 102 are disposed substantially midway between the openings 102 of the adjacent row 100.

Figure 9:
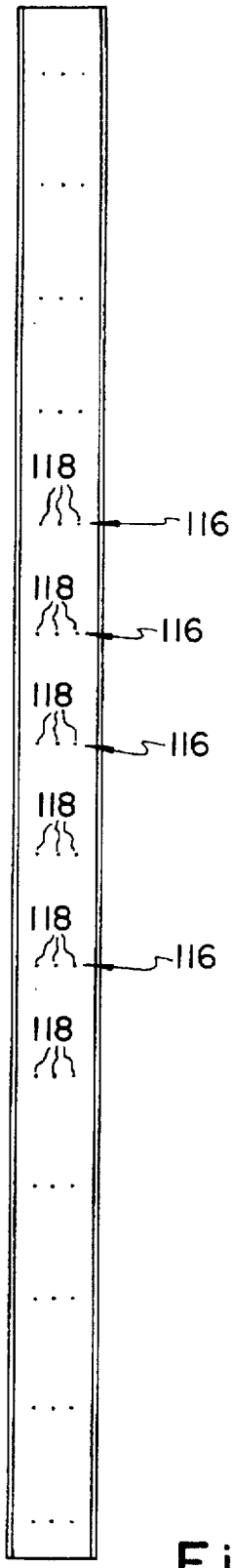
FIG. 9 is an elevational view of the back side of the inner tube of FIG. 6 as taken along line 9—9.

Referring to FIG. 9, there is illustrated an elevational view of the back side of the tube 42 as taken along line 9—9 of FIG. 6. A plurality of spaced rows 116 of openings 118*a*, 118*b*, 118*c* are provided for directing processing solution against the back side BS of photosensitive material 14. The rows are positioned substantially opposite the location of the rows 100 of openings 102. The opening 118 provides impinging processing solution against the back side BS. The openings 118 are sized and shaped so as to provide a stabilizing force against the photosensitive material 14 so as to maintain it at a substantially fixed location within the inner tube 42. Thus, a substantially constant impingement force will be provided by the processing solution against the emulsion side of the photosensitive material 14. The openings 118 vary in size depending upon the distance it is from the back side BS of the photosensitive material 14. In the embodiment illustrated the openings 118 are circular and opening 118*b* has a diameter of 0.052 inches (1.32 mm) and openings 118*a* and 118*c* have a diameter of 0.043 inches (1.09 mm). It is to be understood that the size and shape may be varied so as to provide the appropriate balancing force against the back side BS of the photosensitive material 14.

Referring back to FIGS. 5 and 6, there is illustrated the shape and configuration of outer tube 28. For the sake of clarity and brevity, a description of outer tube 28 will be discussed in detail, it being understood that the remaining outer tubes 30,32,34,36,38 are similarly constructed. As previously discussed, a fluid supply passageway 62 is formed between inner tube 42 and outer tube 28. The inside passageway of tube 28 is substantially elliptical in a cross-sectional shape in much the same manner as tube 42, except larger and preferably concentric therewith. In the particular embodiment illustrated, the major axis A of the tube 28 aligns with the major axis A 42 and the minor axis B of tube 28 aligns with the minor axis B of tube 42 such that a substantially constant thickness TP is provided for passageway 62. However, this is not required. It is important only that the passageway 62 be such that the appropriate flow of processing solution at the appropriate pressure is supplied to the rows 100 of openings 102 and rows 116 of openings 118. Thus, the cross-sectional shape of tube 28 may be circular, or any other desired shape for ease of construction and/or cost of manufacture. Applicants have found it desirable to minimize the amount of processing solution 22 in passageway 62 in order to increase the turnover rate of the processing solution which helps the dead chemical regions of the processing solution and provided a uniform temperature to the processing solution. Providing an elliptical inner cross-sectional configuration to tube 28 assists in minimizing the amount of processing solution. In the particular embodiment illustrated, the thickness TP is about 0.288 inches (7.3 mm). As previously discussed, the outer tubes define the elongated chamber 40 where the length L is several times the maximum width MW. In the embodiment illustrated, L is about 27.0 inches (68.58 cm) and MW is about 1.9 inches (4.8 cm).

Referring back to FIGS. 1 and 3, the rinse section 15 is similar in construction and operation to development section 13, like numerals indicating like parts and operation. Rinse section 15 includes a plurality of tubes 140,142,144,146 which provide two loops 150,152 through which the photosensitive material passes.

Figure 11:
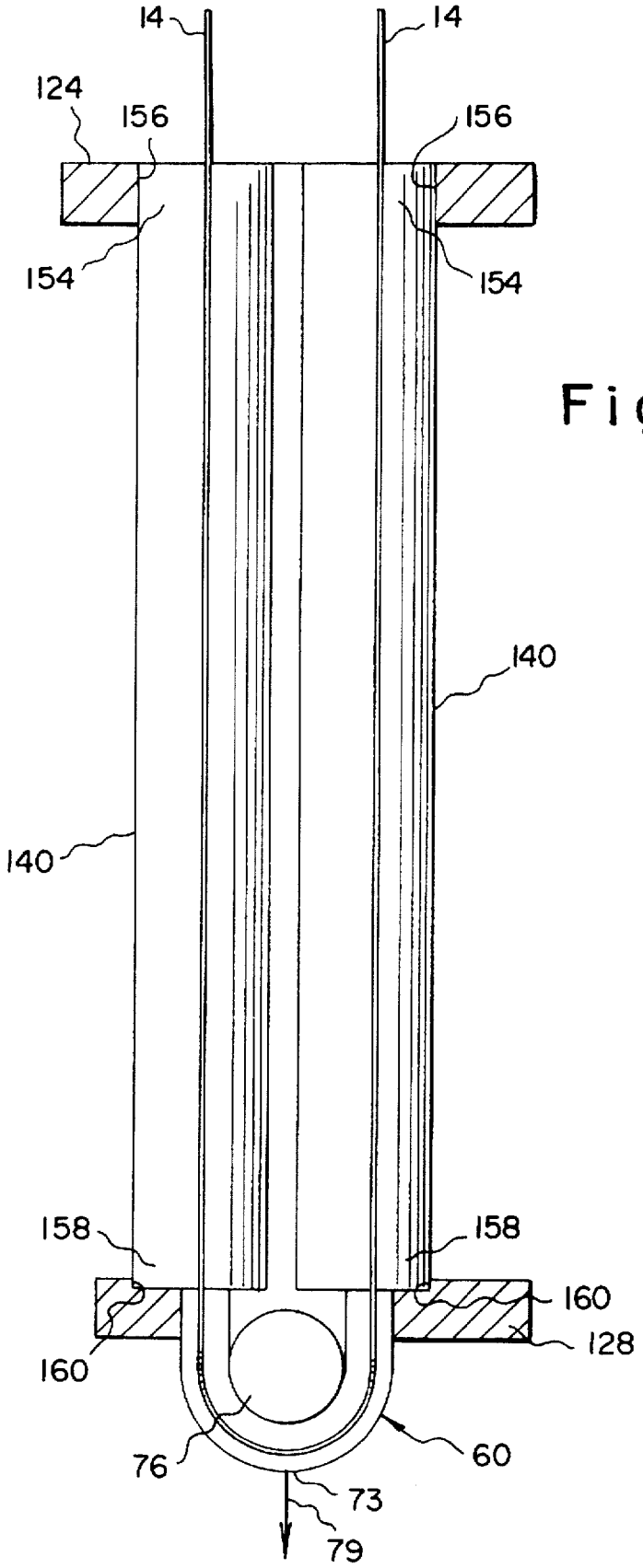
FIG. 11 is a cross-sectional view of one of the processing loops of the rinse section of the apparatus of FIG. 1.

Referring to FIG. 11, there is illustrated loop 150. Loop 152 is constructed in a like manner to loop 150, thus only loop 150 will be described in detail. Typically, it is not as critical as to how the rinse solution is applied to the photosensitive material 14. Thus, in the embodiment illustrated only single tubes 140 are provided in loop 150. The tops 154 of tubes 140 are matingly received in openings 156 in mounting plate 124 and the bottoms 158 of tubes 140 are matingly received in recesses 160 in the bottom mounting plate 25. The tops 154 and bottoms 158 are secured to their respective mounting plate by appropriate adhesives.

Referring to FIG. 4, a recirculation system 162 is provided which is similar to recirculation system 80, like numerals indicating like parts and operation. Thus, rinse solution 26 is circulated through tubes 140 for rinsing of the photosensitive material. However, if desired or required, the dual tube system used in the development section could also be used in the rinse section 15.

Appropriate mechanisms are provided in apparatus 10 for driving and guiding of the photosensitive material through the apparatus 10. In order to assist in driving the photosensitive material 14, there is provided a motor 166 used to rotate drive shaft 168, which in turn drives a plurality of drive rollers 170, which engage the photosensitive material. Guide rollers 171 are also provided for guiding of the photosensitive material. The guide rollers 171 and/or drive rollers, as appropriate, guide the photosensitive material 14 into and out of the inner tubes, thus establishing an initial and exiting orientation and position. The turn-around rollers 76 establish an intermediate orientation and positioning for the photosensitive material 14. The openings 102 and 118 provide orientation and positioning of the photosensitive material therebetween. It is to be understood that any type drive and guide mechanisms may be used for transporting and guiding of the photosensitive material 14 through the apparatus 10.

In order to more fully understand the present invention, a description of it operation will now be provided. Development section 13 is appropriately filled with a sufficient amount of processing solution 22 to fill sump 20, recirculation system 80, inner and outer tubes. Likewise, the rinse section 15 is appropriately filled with a sufficient amount of rinse solution 26 to fill sump 24, recirculation system 162 and tubes 140. A web 14 of photosensitive material passes through the various processing and rinsing loops of the apparatus 10. This is typically accomplished by first threading a leader of a web of material through the processor and then securing the web to be processed to the end of the leader. Photosensitive material enters the first loop 65 through inner tube 42 and passes around turn-around section 60 out inner tube 44. The photosensitive material 14 may pass around one of the drive rollers 170 which are used to drive the photosensitive material 14 through the apparatus 10. The photosensitive material 14 then enters loop 67 through inner tube 46 and travels around turn-around section 60 and out through inner tube 48 and then around one of the drive rollers 170. The photosensitive material 14 then enters the last loop 67 through inner tube 50 and travels around the turn-around section 60 and out inner tube 52. The photosensitive material 14 then leaves the development section 13 and goes to rinse section 15. The photosensitive material 14 enters loop 150 into tube 140 and travels around turn-around section 60 and out through tube 142. Then the photosensitive material 14 passes over an appropriate drive roller 170 into loop 152 through tube 144 and travels around turn-around section 60 and out tube 146. The photosensitive material 14 is then directed to the next processing station which may be another processing section 12, drier section (not shown), or directed out of the apparatus.

In the preferred embodiment, the elongated processing chamber is provided by tubes 28,30,32,34,36,38, as this is economical to fabricate and assemble. However, the chamber 40 may be of any other construction, for example, drilled in a single block member.

It is to be understood that various other modifications and changes may be made without departing from the scope of the present invention, the present invention being defined by the claims that follow.

Parts List:

| | |
|---|---|
| 10 | processing apparatus |
| 12 | processing section |
| 13 | development section |
| 14 | photosensitive material |
| 15 | rinse section |
| 16 | upper mounting section |
| 17 | upstanding wall |
| 18 | lower mounting section |
| 19 | fluid retention well |
| 20 | processing sump |
| 21 | fluid retention well |
| 22 | processing solution |
| 23 | upper mounting plate |
| 24 | rinse sump |
| 25 | lower mounting plate |
| 26 | rinsing solution |
| 28,30,32,34,36,38 | outer tubes |
| 39 | inlet port |
| 40 | processing chamber |
| 42,44,46,48,50,52 | inner tubes |
| 53 | upper open end |
| 54 | tops |
| 55 | lower open end |
| 56 | bottoms |
| 60 | turn-around section |
| 61 | passageway |
| 62 | fluid supply passageway |
| 65,67,69 | processing loops |
| 72,74 | lower ends |
| 76 | turn-around rollers |
| 78 | discharge opening |
| 79 | arrow |
| 80 | recirculation system |
| 82,87 | conduit |
| 84 | outlet |
| 86 | pump |
| 88,90 | outlet |
| 89 | filter |
| 92 | heater |
| 94 | manifold |
| 95,97,99,101,103,105 | conduits |
| 96 | conduit |
| 98 | outlet |
| 100 | plurality of rows |
| 102a,102b,102c,102d,102e | openings |
| 107 | surface |
| 108,112 | dash lines |
| 109 | line |
| 116 | spaced rows |
| 118a,118b,118c | openings |
| 122,126,136 | mating recess |
| 124 | mounting plate |
| 130,132 | openings |
| 134 | lower end |
| 139 | O-ring seal |
| 140,142,144,146 | plurality of tubes |
| 150,152 | loops |
| 154 | tops |

-continued

| Parts List: | |
|---|---|
| 156 | openings |
| 158 | bottoms |
| 160 | recesses |
| 162 | recirculation system |
| 166 | motor |
| 168 | drive shaft |
| 170 | drive rollers |
| 171 | guide rollers |

We claim:

1. In a processing apparatus for processing a web of photosensitive material having an emulsion layer on one side, said apparatus having at least one development section comprising:

a) an outer tube, said outer tube having an entrance port for receiving a processing solution under pressure; and b) an inner tube for receiving a web of photosensitive material having an emulsion layer therethrough, said web having a longitudinal axis, said inner tube being disposed within said outer tube and forming a fluid passageway between said outer tube and said inner tube, said inner tube having at least one row of processing openings for introducing fluid from said passageway into said inner tube and against said emulsion layer, said row of processing openings being positioned in said inner tube so that the at least one row of openings face the emulsion layer and are disposed at an angle with respect to said longitudinal axis of said web.

2. In an apparatus according to claim 1 wherein said inner tube has a substantially elliptical cross-sectional shape, and said openings of said at least one row of processing openings which are positioned furthest from the emulsion layer have a size greater than the processing openings closer to said emulsion layer.

3. In an apparatus according to claim 1 wherein a plurality of spaced rows of processing openings are provided along the length of said inner tube, said rows of processing openings being offset with respect to the adjacent row of processing openings.

4. In an apparatus according to claim 3 wherein said processing openings in said adjacent rows are offset a distance such that the processing openings are substantially midway between the processing openings of the adjacent row.

5. In an apparatus according to claim 1 wherein at least one row of support openings are provided in said inner tube at a position opposite said at least one row of processing openings so as to provide fluid pressure to the backside of said web of photosensitive material.

6. In an apparatus according to claim 5 wherein said support openings in said at least one row have a greater size the further it is spaced from the web of photosensitive material passing thereby.

7. In an apparatus according to claim 1 wherein said inner tube having an exit for allowing processing solution to pass from the inner tube into a recirculation system for recirculating of the processing solution back to the inlet port of said outer tube.

8. In an apparatus according to claim 2 wherein said elliptical shape has a major axis and a minor axis, said web of photosensitive material having a planar surface on which said emulsion is provided, said major axis being substantially co-extensive with said planar surface, said row of processing openings comprise five openings being substantially centered about the minor axis and spaced across the emulsion layer.

9. In an apparatus according to claim 1 wherein said angle ranges from about 10° to 45°.

10. In a processing apparatus for processing a web of photosensitive material having an emulsion layer on one side, said apparatus having at least one development section comprising:

a) a first elongated processing chamber having a first entrance port for receiving a processing solution under pressure;

b) a first inner tube disposed within said first elongated processing chamber and forming a fluid passageway between said elongated processing chamber and first inner tube;

c) a second elongated processing chamber having an second entrance port for receiving a processing solution under pressure;

d) a second inner tube disposed within said second elongated processing chamber and forming a fluid passageway between said exit elongated processing chamber and second inner tube; and e) a turn-around section for connecting said first inner tube to said second inner tube, said web passing through said first inner tube and second tube at a fixed predetermined orientation and position so as to define a longitudinal axis with respect to said photosensitive material, said first and second inner tubes each having at least one row of processing openings for introducing fluid from said passageway into said inner tubes and against said emulsion layer, said row of processing openings being positioned so that the rows of openings face the emulsion layer and are disposed at an angle with respect to said longitudinal axis of said web.

11. In an apparatus according to claim 10 wherein said first and second inner tubes each have a substantially elliptical cross-sectional shape, and said openings in said at least one row of processing openings which are positioned furthest from the emulsion layer having a size greater than the processing openings closer to said emulsion layer.

12. In an apparatus according to claim 10 wherein a plurality of spaced rows of processing openings are provided along the length of said first and second inner tubes, said rows of processing openings being offset with respect to the adjacent row of processing openings.

13. In an apparatus according to claim 12 wherein said processing openings in said adjacent rows are offset a distance such that the processing openings are substantially midway between the processing openings of the adjacent row.

14. In an apparatus according to claim 10 wherein at least one row of support openings are provided in said first and second inner tubes at a position opposite said at least one row of processing openings so as to provide fluid pressure to the backside of said web of photosensitive material.

15. In an apparatus according to claim 14 wherein said support openings in said at least one row have a greater size the further it is spaced from the web of photosensitive material passing thereby.

16. In an apparatus according to claim 10 wherein said inner tube having an exit for allowing processing solution to pass from the inner tube into a recirculation system for recirculating of the processing solution back to the inlet port of said outer tube.

17. In an apparatus according to claim 11 wherein said elliptical shape has a major axis and a minor axis, said web of photosensitive material having a planar surface on which said emulsion is provided, said major axis being substantially co-extensive with said planar surface, said row of processing openings comprise five opening being substantially centered about the minor axis and spaced across the emulsion layer.

18. In an apparatus according to claim 10 wherein said angle ranges from about 10° to 45°.

19. A processing apparatus for processing a web of photosensitive material having an emulsion layer on one side, said apparatus having at least one development section comprising:

a) an elongated narrow processing chamber having an entrance port for receiving a processing solution under pressure; and b) a processing tube disposed within said elongated narrow processing chamber and forming a narrow fluid passageway between said chamber and said processing tube, said web passing through said processing tube at a fixed predetermined orientation and position so as to define a longitudinal axis with respect to said photosensitive material, said processing tube having means for introducing processing fluid from said passageway into said processing tube against said emulsion layer substantially across the width of said the emulsion layer.

20. In an apparatus according to claim 19 wherein said processing tube has a substantially elliptical cross-sectional shape, and means for introducing processing solution comprises a plurality of spaced rows of processing openings which face the emulsion layer, said row of processing openings which are positioned furthest from the emulsion layer having a size greater than the processing openings closer to said emulsion layer.

21. In an apparatus according to claim 20 wherein at least one of said plurality of spaced rows is offset with respect to the adjacent row of processing openings.

22. In an apparatus according to claim 21 wherein said processing openings in said adjacent rows are offset a distance such that the processing openings are substantially midway between the processing openings of the adjacent row.

23. In an apparatus according to claim 20 wherein at least one row of support openings are provided in said processing tube at a position opposite said at least one row of processing openings so as to provide fluid pressure to the backside of said web of photosensitive material.

24. In an apparatus according to claim 23 wherein said support openings in said at least one row have a greater size the further it is spaced from the web of photosensitive material passing thereby.

25. In an apparatus according to claim 19 wherein said inner tube is provided having an exit for allowing processing solution to pass from the inner tube into a recirculation system for recirculating of the processing solution back to the inlet port of said elongated narrow processing chamber.

26. An apparatus according to claim 20 wherein said rows of openings are disposed at an angle ranging from about 10° to 45°.

* * * * *